United States Patent [19]

Tannatta

[11] Patent Number: 4,608,975

[45] Date of Patent: Sep. 2, 1986

[54] EMERGENCY BREATHING APPARATUS

[76] Inventor: Raymond A. Tannatta, 989 Balltown Rd., Schenectady, N.Y. 12309

[21] Appl. No.: 521,586

[22] Filed: Aug. 9, 1983

[51] Int. Cl.[4] ..... A62B 7/00

[52] U.S. Cl. ..... 128/202.13; 128/206.12; 128/206.28; 128/207.12

[58] Field of Search ..... 128/200.24, 201.22, 128/201.23, 201.24, 201.25, 201.26, 201.27, 201.28, 201.29, 202.13, 202.19, 204.18, 205.25, 206.12, 206.21, 206.28, 207.12; 4/209 R, 207, 661; 98/29, 33 R

[56] References Cited

U.S. PATENT DOCUMENTS

| | | | |
|---|---|---|---|
| 4,165,738 | 8/1979 | Graves et al. | 128/202.13 |
| 4,320,756 | 3/1982 | Holmes | 128/200.24 |
| 4,331,139 | 5/1982 | Popa | 128/202.13 |
| 4,373,522 | 2/1983 | Zien | 128/200.24 |
| 4,440,164 | 4/1984 | Werjefeit | 128/202.13 |
| 4,467,796 | 8/1984 | Beagley | 128/200.24 |

FOREIGN PATENT DOCUMENTS

| | | | |
|---|---|---|---|
| 1595899 | 8/1981 | United Kingdom | 4/207 |

*Primary Examiner*—Henry J. Recla
*Assistant Examiner*—Kavin M. Reichle
*Attorney, Agent, or Firm*—Gerhard K. Adam

[57] ABSTRACT

Apparatus for protecting persons trapped in burning buildings from injury resulting from breathing of combustion products comprises a plumbing pipe segment disposed between a plumbing trap element and a plumbing system vent line having a releasably sealed port therein. An easily removable fluid sealing cap is installed on the port to provide for normal drain operation. A flexible conduit sealingly attached to a breathing mask at one end and to a fluid sealing connector device adapted to be connected to the port at the other end is also provided. In the event of fire, the user releases the sealing cap from the port and connects the fluid sealing connector at one end of the flexible conduit to the port thereby being provided with access through the mask, conduit, port, and vent line to a supply of building exterior, breathable, air free from harmful combustion products.

7 Claims, 4 Drawing Figures

33
31
32
42
14
11
13
12
22
23
21
24

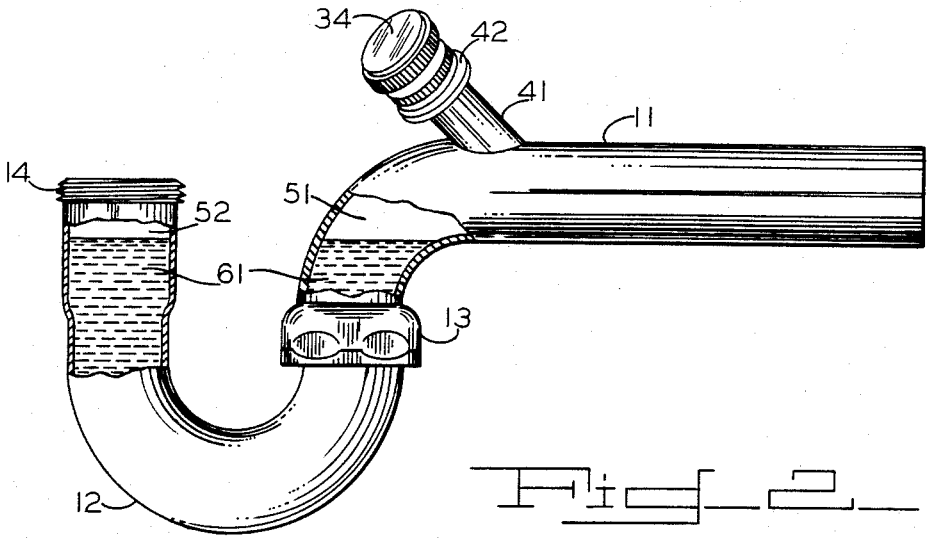
Fig. 2
Fig. 3
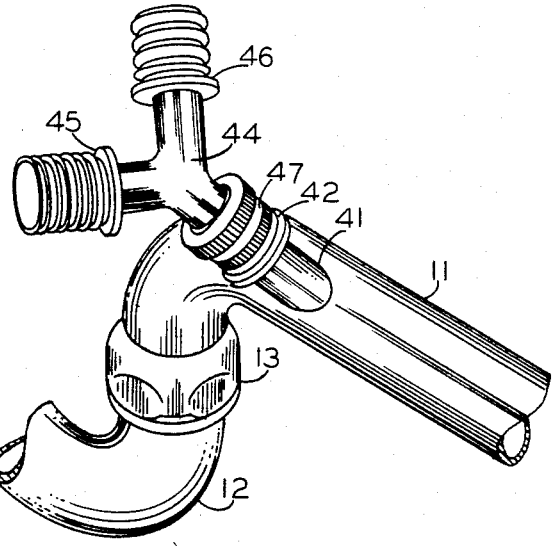
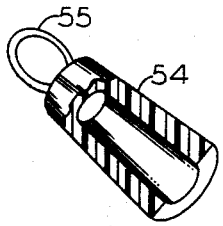
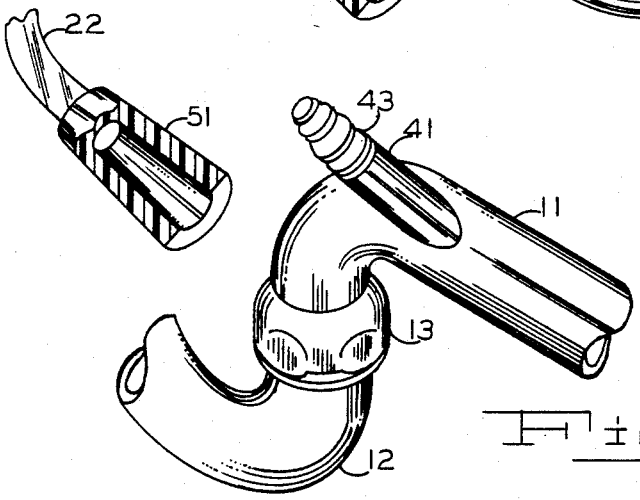
Fig. 4

EMERGENCY BREATHING APPARATUS

This invention relates to breathing apparatus for the protection of persons trapped in burning buildings, and more particularly to such apparatus utilizing the existing plumbing system of such buildings to provide access to breathable air for protection against injury resulting from inhalation of combustion products within the building.

A person in a modern high-rise structure, such as a hotel or motel, who becomes trapped therein in the event of fire in which the fire itself, or structural damage to the building, or the person's infirmaties or handicaps prevent the person from obtaining egress from the building is in serious danger of death before emergency personnel can effect his rescue. The vast majority of deaths of persons trapped in burning structures is the result of poisoning or lung damage from inhalation of combustion products rather than from heat injury or any other cause. It is a particularly great tragedy that many persons die in fires in hotels and motels from inhalation of combustion products while they are literally only a few feet away from a source of safely breathable air. Hotel and motel rooms are universally provided with a lavatory sink in each room. Each lavatory sink has a drain provided with a trap connected between the lavatory sink and the building plumbing system vent lines. The plumbing system vent lines communicate with, and contain, building exterior air which is breathable. The trap is filled with water preventing communication between the exterior air in the vent system and the interior of the room.

It is accordingly an object of this invention to provide apparatus to render the breathable air in a building plumbing vent system accessible to persons trapped within the building.

It is another object of this invention to provide such apparatus which is inexpensive to manufacture and install.

It is an another object of this invention to provide such apparatus which is simple to use so that a person in an emergency situation can reliably employ the same.

Briefly, and in accordance with one embodiment of this invention, a plumbing pipe segment for connection of a lavatory sink drain trap to the building plumbing system vent line is provided with a port extending into the room. The port is provided with means for releasably securing a fluid sealing member thereto. A first fluid sealing member to seal said port and isolate the vent system from the room is provided for isolation of the vent under normal conditions. A flexible conduit connected to a breathing mask at one end and to a second fluid sealing member at the other end is provided for use under fire emergency conditions. In the event of being trapped in his room in case of fire, the occupant releases the first fluid sealing member from the port, replaces it with the second fluid sealing member connected to the conduit, and is thereby enabled to breath the safe air of the vent system until a safe means of egress from the building can be provided.

The novel features of this invention sought to be patented are set forth with particularity in the appended claims. The invention, together with further objects and advantages thereof, may be understood from a reading of the following specification and appended claims in view of the accompanying drawings in which:

FIG. 2 is a side elevation view, partially broken away, of a plumbing trap and vent conduit having an outlet port in accordance with one embodiment of this invention in said vent conduit.

FIG. 3 is an isometric view of a portion of the apparatus of FIG. 1 in which a multiple connector is installed upon the outlet port in accordance with another embodiment of this invention.

FIG. 4 is an isometric view of a portion of the apparatus of FIG. 1 showing an alternative configuration for the outlet port, cap, and conduit connector in accordance with another embodiment of this invention.

Figure 1:
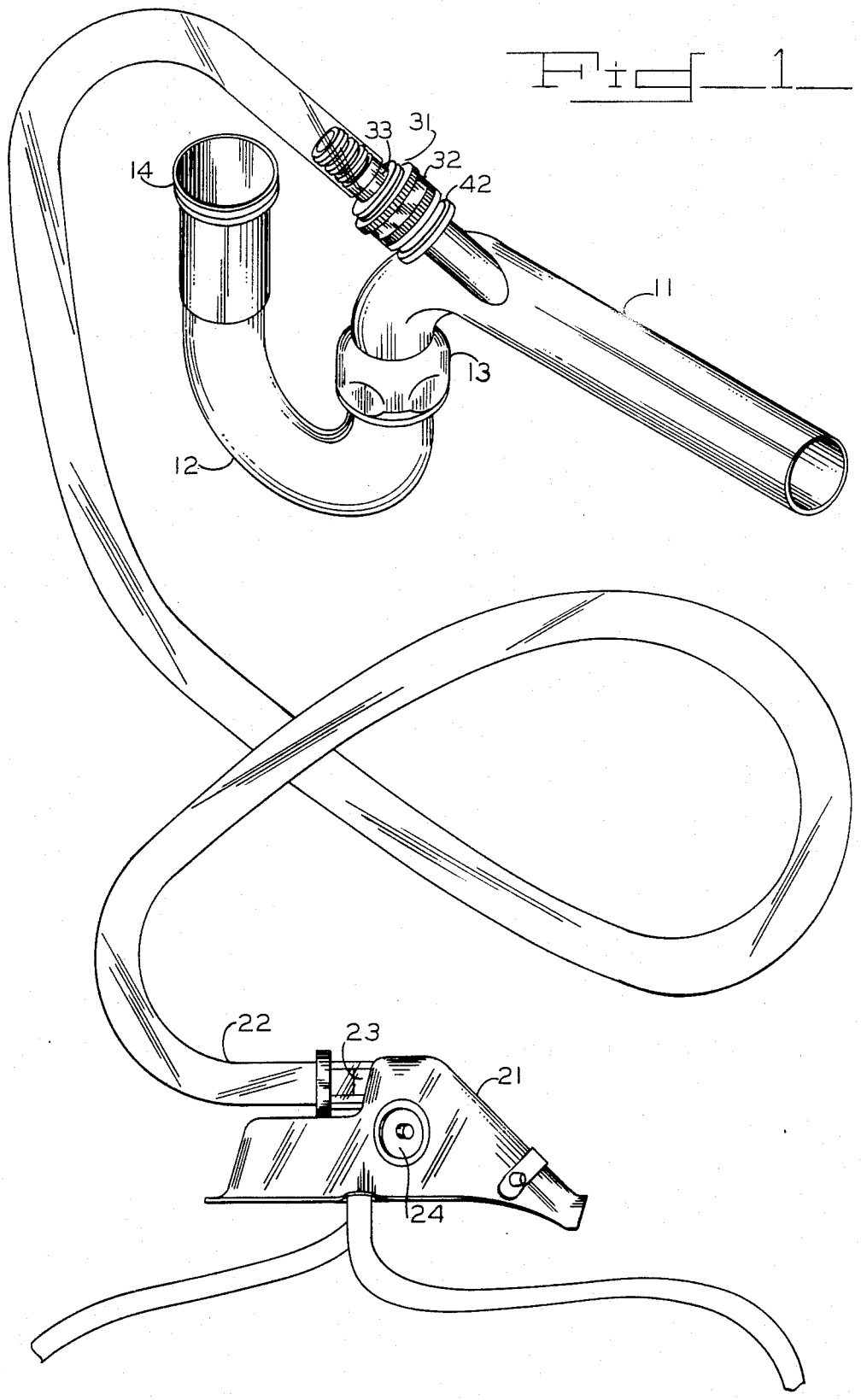
FIG. 1 is an isometric drawing of emergency breathing apparatus in accordance with one embodiment of this invention.

Referring initially to FIG. 2, a standard plumbing trap 12 is connected to a vent conduit 11 by collar nut 13. As is known in the art, vent conduit 11 is connected at its end opposite trap 12 to the building plumbing system vent line, not shown. The vent line is open to building exterior air. As is known in the art, trap 12, when installed in a drain system, at all times contains a quantity of water 61 therein. Building exterior vent line air is present in conduit 11 up to the point, 51, at which it meets the surface of water 61. Building interior air is present up to the point 52 at which it is blocked by the water 61 in trap 12. The quantity of water 61 serves to prevent the mixing between quantities of air at 51 and quantities of air at 52. In accordance with this invention, an outlet port 41 is provided in vent conduit 11, on an upper surface thereof, for the purpose of introducing breathable vent system air into the interior of the building when required under fire emergency conditions. Outlet port 41 is provided with a threaded male end 42 which, as shown in FIGS. 1, 2 and 3 may be a standard garden hose male end, to provide for the removable connection of other apparatus to outlet port 41. Outlet port 41 is preferably installed in vent conduit 11 off-set from the center line thereof and angled forwardly to provide for convenient access to the outlet port through threaded male end 42. Under normal conditions, outlet port 41 is sealed by attaching a standard cap 34 to threaded male end 42.

In the event of a fire emergency, in which the room in which the apparatus hereinabove described has been installed, becomes filled with harmful combustion products, the occupant reaches under the lavatory sink in which the apparatus as illustrated in FIG. 2 has been installed, removes cap 34 from threaded male end 42, and installs connector 31, as shown in FIG. 1, upon threaded male end 42 to avail himself of a supply of breathable air supplied from the exterior of the building through the building plumbing system vent line. Turning to FIG. 1, connector 31 is an adaptor comprising rotatable member 32 which screws on to threaded male end 42 thereby connecting outlet port 41 to knurled member 33 to which is fluid sealingly attached, by, for example, pressure fit, one end of flexible conduit 22. Flexible conduit 22 may conveniently be a length of plastic tubing several feet long. The end of flexible conduit 22 opposite member 33 is fluid sealingly connected to a breathing mask 21. Mask 21 is a standard breathing mask, as is known in the art, and is configured to conform to the face of a human user, and to cover the nose and mouth of the user. The mask for use in accordance with this invention is preferably equipped with a one-way valve 24, such as is known in the art, to provide for the venting of the user's exhalation to the interior of the room and the sealing of the mask so that the user inhales only through flexible conduit 22. This provides, even in cases in which many users have connected breathing apparatus in accordance with this invention to vent conduits in each of many rooms of a hotel or motel, for only negative pressures being applied through conduits 22 to the plumbing system vent, thereby assuring a continuous flow of building exterior air into the vent system. If desired, a filter 23 may be provided at the entry port of mask 21 to reduce unpleasant odors in the air delivered to the user from the plumbing system vent. Filter 23 is not necessary since a user of the system will undoubtedly choose to breath the breathable air provided through the plumbing vent system and the apparatus of this invention over the poisonous combustion products in the room. Tests have been performed on the air contained in typical plumbing system vent lines, and it has been found to be fully breathable, and to contain no harmful components in any significant levels at all. Therefore, the employment of a filter 23 is a purely optional consideration for the olfactory sensibilities of the user.

In the event that more than one person is trapped in a single room in which the lavatory sink, or other plumbing drain, is equipped with apparatus as shown in FIG. 2 and described hereinabove, an adaptor as shown in FIG. 3 is employed. After cap 34, as shown in FIG. 2, is removed from threaded male end 42, connector 47 is installed on threaded male end 42, thereby connecting Y-adaptor 44 having threaded male ends 45 and 46 on the branches thereof, to outlet port 41. It is intended that each room of a hotel or motel using the apparatus of this invention will have its lavatory sink drain modified as shown in FIG. 2, and will be provided with an adaptor as shown in FIG. 3, and two mask, conduit, and connector assemblies as shown in FIG. 1. Emergency exit instructions will be provided to guests, and additionally, instructions in the use of the apparatus of this invention in the event that exit paths are blocked. A single room occupant is instructed to remove cap 34 and install one breathing mask and conduit assembly as shown in FIG. 1. For rooms having plural guests, the instructions are to remove cap 34, install the adaptor shown in FIG. 3, and connect both mask and conduit sub-assemblies to the threaded male ends 45 and 46 of the adaptor.

FIG. 4 illustrates an embodiment of this invention in which alternative configurations for the threaded end, cap, and connector, are used. In the embodiment of FIG. 4, outlet port 41 terminates in male end 43 having a tapered ridged or knurled surface adapted to fluid sealingly mate by pressure fit with cap member 54 or connector member 51. Under normal conditions, cap 54 is installed on male end 43 to seal the system as hereinabove described. Cap 54 is provided with a ring 55 to facilitate its removal under emergency conditions, after which removal, connector 51, having flexible conduit 22 attached thereto is press-fit onto male end 43. Conduit 22 as shown in FIG. 4 is the same item as conduit 22 as shown in FIG. 1, and is connected to a breathing mask as shown in FIG. 1.

With reference to the description set forth hereinabove, the multiple adaptor shown in FIG. 3 could be modified for use with the connector system shown in FIG. 4.

The embodiment shown in FIG. 4 has the advantage of being simpler to use in that cap 54 need be merely pulled off male end 43 and connector 51 pushed on in its place, whereas in the embodiment illustrated in FIGS. 2 and 1, cap 34 must be unscrewed from threaded male end 42 and connector 31 screwed onto the nipple in its place. On the other hand, the forces applied to vent conduit 11 by pulling off cap 54 and pushing on connector 51 present a small, but recognizable, risk of fracturing vent conduit 11. In the event that such fracture occurred building interior air could enter the vent system through the fracture, thereby defeating the utility of this invention. It has been found that persons confronted with emergency situations do not tend to panic as long as there is a known course of action for them to follow. Panic, together with its concomitant non-functional or counter-productive behavior is unlikely to occur as long as the person confronted with the fire emergency situation knows the steps to be performed in using the apparatus of this invention. Therefore, the task of unscrewing the cap member and connecting the breathing mask to the outlet port is considered to be within the capabilities of persons in a fire emergency situation. Therefore, because the greater simplicity of connecting the breathing apparatus of this invention in accordance with the embodiment of FIG. 4 is considered a non-critical advantage, it is considered to be over-weighed by the greater liklihood of damage to the system, and the embodiment illustrated in FIGS. 1 and 2 is preferred. An intermediate configuration between that shown in FIGS. 1 and 2, on the one hand, and that shown in FIG. 4, on the other hand, is also possible; for example, mating bayonet type connectors could be used, in which a compression loaded connector set is pushed partially together, and then secured by a half-twist. Other secondary advantages of the embodiment of this invention illustrated in FIGS. 1 and 2 are that threaded male end 42, cap 34, connector 32, and the entire Y-adaptor assembly illustrated in FIG. 3 may conveniently comprise standard garden hose fittings which are readily available, inexpensive, present the typical user with apparatus with which he is familiar, and readily allow for use of the apparatus under normal, non-emergency, conditions for connection to vent conduit 11 of high pressure fluid sources for maintenance operations such as flushing.

While this invention has been described with reference to particular embodiments and examples, other modifications and variations will occur to those skilled in the art in view of the above teachings. Accordingly, it should be understood that, within the scope of the appended claims, this invention may be practiced otherwise than is specifically described.

The invention claimed is:

1. An emergency breathing apparatus for use in a building having a vented plumbing system which includes a sink, a sink trap having two open ends and connected to the sink at one end, and a plumbing and venting line in fluid communication with fresh air at the exterior of said building, said apparatus comprising:

at least one breathing mask having exhaust valve means;

a connecting sink drainage pipe section having a first open end and a second open end and defining an open-ended tubular outlet extending out from the exterior surface of said pipe section, said tubular outlet disposed adjacent the first end of said pipe section with the free end located above the other open end of said outlet which is connected to said pipe section, said first end of said pipe section having means for attaching said first end directly to the other end of the sink trap and the second end of said pipe section have means for attaching said second end directly to the plumbing and venting line;

connecting means disposed at the free open end of said tubular outlet;

removable cap means adapted for attachment to the connecting means for sealing the free open end of said outlet from the atmosphere surrounding said pipe section when the pipe section, in combination with the sink trap and plumbing and venting line, is being used for plumbing; and at least one flexible conduit having a first open end connected to the interior of said at least one mask and a second open end adapted for attachment to the connecting means during emergency use, when the atmosphere in the interior of said building and thereby surrounding said pipe section is unfit for breathing whereby fresh air from the vented plumbing system is able to pass into said mask from the plumbing and venting line through said pipe section and said flexible conduit.

2. The emergency breathing apparatus is claimed in claim 1, wherein said connecting means includes a Y-adaptor, one arm of said Y-adaptor adapted for connection to said tubular outlet during emergency use and the other arms adapted for connection to said at least one flexible conduit.

3. The emergency breathing apparatus as claimed in claim 1, wherein said connecting means is a knurled male fluid connection member.

4. The apparatus of claim 3 wherein said second end of said flexible conduit is adapted for attachment to said knurled male fluid connection member by means comprising a truncated conical member of resilient material having an open base end adapted for connection to said male member and an open apex end connected to said second end of said flexible conduit.

5. An emergency breathing apparatus for use in a building having a vented plumbing system which includes a sink, a sink trap having two open ends and connected to the sink at one end, and a plumbing and venting line in fluid communication with fresh air at the exterior of said building, said apparatus comprising:

a breathing mask having exhaust valve means;

a connecting sink drainage pipe section having a first open end and a second open end and defining an open-ended tubular outlet extending out from the exterior surface of said pipe section, said tubular outlet disposed adjacent the first end of said pipe section with the free end of said outlet located above the other end of said outlet which is connected to the pipe section, the first end of said pipe section having means for attaching said first end directly to the other end of the sink trap and the second end of said pipe section having means for attaching said second end directly to the plumbing and venting line;

threaded connecting means disposed at the free open end of said tubular outlet;

removable threaded cap adapted for attachment to the threaded connecting means for sealing the free open end of said outlet from the atmosphere surrounding said pipe section when the pipe section, in combination with the sink trap and plumbing and venting line, is being used for plumbing; and a flexible conduit having a first open end connected to the mask and fluidically communicating with the interior thereof and a second open end adapted for attachment to the threaded connecting means during emergency use when the atmosphere in the interior of said building and thereby surrounding said pipe section is unfit for breathing whereby fresh air from the exterior of the building is able to pass into said mask from the plumbing and venting line through said pipe section and said flexible conduit.

6. The apparatus of claim 5 wherein said second end of the flexible conduit is adapted for attachment to said threaded connecting means by means including a male fluid connection member having one knurled open end adapted for pressure fitting into said second end of the flexible conduit and an opposite open end; a threaded connector rotatably and fluidically attached to the opposite end of said male fluid connection member and adapted for attachment to said threaded connecting means.

7. An emergency breathing apparatus for use in a building having a vented plumbing system which includes a sink, a sink trap having two open ends and connected to the sink at one end, and a plumbing and venting line in fluid communication with fresh air at the exterior of said building, said apparatus comprising:

a breathing mask having exhaust valve means;

a connecting sink drainage pipe section having a first open end and a second open end and defining an open-ended tubular outlet extending out from the exterior surface of said pipe section, said tubular outlet disposed adjacent the first end of said pipe section with the free end of said outlet located above the other open end of said outlet which is connected to the pipe section, the first end of said pipe section having means for attaching said first end directly to the other end of the sink trap and the second end of said pipe section having means for attaching said second end directly to the plumbing and venting line;

a knurled male fluid connecting member disposed at the free open end of said tubular outlet;

a truncated conical cap member of resilient material having an open base end and a closed apex end and a ring member attached to an outer surface of said apex end, said cap member being adapted for attachment to the knurled male fluid connecting member for sealing the free open end of said outlet from the atmosphere surrounding said pipe section when the pipe section, in combination with the sink trap and plumbing and venting line, is being used for plumbing; and a flexible conduit having a first open end connected to the mask and fluidically communicating with the interior thereof and a second open end adapted for attachment to the male fluid connecting member during emergency use when the atmosphere in the interior of said building and thereby surrounding said pipe section is unfit for breathing whereby fresh air from the exterior of the building is able to pass into said mask from the plumbing and venting line through said pipe section and said flexible conduit.

* * * * *